United States Patent [19]

Strain et al.

[11] 4,412,830

[45] Nov. 1, 1983

[54] COVER FOR CENTRIFUGE ROTOR

[75] Inventors: David H. Strain, Los Gatos; John H. Sutton, III, Belmont, both of Calif.

[73] Assignee: Beckman Instruments, Inc., Fullerton, Calif.

[21] Appl. No.: 391,670

[22] Filed: Jun. 24, 1982

[51] Int. Cl.[3] ..... B04B 7/02

[52] U.S. Cl. ..... 494/12; 494/16

[58] Field of Search ..... 494/12, 16, 38, 39; 220/284, 210, 327; 366/347

[56] References Cited

U.S. PATENT DOCUMENTS

| | | | |
|---|---|---|---|
| 2,783,938 | 3/1957 | Grela et al. | 233/11 |
| 2,827,229 | 8/1958 | Blum | 233/23 |
| 3,028,075 | 4/1962 | Blum | 233/26 |
| 3,168,473 | 2/1965 | Goda et al. | 233/26 |
| 3,233,825 | 2/1966 | Lomb | 233/24 |
| 3,567,113 | 3/1971 | Stansell | 233/24 |
| 3,819,111 | 6/1974 | Romanauskas | 233/27 |
| 3,961,745 | 6/1976 | Wright | 233/1 B |
| 3,990,633 | 11/1976 | Stahl et al. | 233/23 R |

*Primary Examiner*—Robert W. Jenkins

*Attorney, Agent, or Firm*—R. J. Steinmeyer; F. L. Mehlhoff; A. A. Canzoneri

[57] ABSTRACT

A cover having a free-turning knob in its center for use on the rotor of a centrifuge. The knob includes tool means for coupling the knob with a threaded fastener securing the rotor to a drive shaft. Thus, when the cover is positioned on the rotor, the threaded fastener securing the rotor can be tightened or loosened by a turning of the knob. The rotor can thereby be removed and replaced without the use of external tools.

6 Claims, 4 Drawing Figures

COVER FOR CENTRIFUGE ROTOR

BACKGROUND OF THE INVENTION

This invention relates generally to centrifuges and more particularly to an improved cover for a centrifuge rotor.

In many centrifuges the rotor is secured to a drive shaft by some type of threaded fastener. It is, perhaps, the most common practice to clamp the rotor against a shoulder provided on the drive shaft with a headed bolt or cap screw. Such a screw is sometimes called a rotor "tie-down" screw. In most cases, a hole is provided in the center of the rotor through which the tie-down screw extends, to engage a tapped hole in the end of the drive shaft. Another, somewhat less common arrangement is for the portion of the drive shaft above the shoulder to extend all the way through the center of the rotor. In this arrangement, external screw threads are provided on the end of the drive shaft which are engaged by a nut, called a rotor tie-down nut, which serves to clamp the rotor to the drive shaft.

During operation of the centrifuge, vibratory forces may be developed which have a loosening effect on threaded fastenings. It is generally necessary, therefore, to tighten the rotor tie-down screw or nut at least moderately tight to ensure safe retention of the rotor by the drive shaft during operation of the centrifuge. The user of the centrifuge must have a wrench for loosening and tightening the rotor tie-down screw or nut each time the rotor is to be removed or replaced on the centrifuge.

As various clinical and industrial centrifugation procedures require samples of differing volume as well as containers of differing size and shape, it is not uncommon for a centrifuge to be equipped with a complement of rotors. Each rotor may be adapted to a specific purpose such as to hold a particular type or quantity of sample container. The operations of some users require that they make frequent rotor changes. Therefore, it would represent a considerable convenience to such users if they could accomplish the removal and replacement of centrifuge rotors without using wrenches or other external tools. A solution to this problem is found in the improvements in centrifuge design provided by the present invention.

SUMMARY OF THE INVENTION

The present invention provides an improved cover for a centrifuge rotor. The rotor is of a type having an opening through its center of rotation and is mounted on a drive shaft by a threaded fastener at the top of the rotor.

The cover includes a cover body having an opening through the center. A knob is mounted in the center of the cover and, although captively retained, the knob is free to turn with respect to the cover body. Tool means are included in the knob for rotatably coupling the knob to the threaded fastener, securing the rotor to the drive shaft. The fastener can be tightened and loosened by turning the knob, thereby eliminating any need for separate wrenches or tools to remove or replace the rotor.

In one embodiment of the invention, the knob contains a socket adapted for receiving and driving a threaded fastener. In another embodiment of the invention, the knob includes a key which is adapted to be received by a threaded fastener to establish a driving engagement between the key and the fastener.

DETAILED DESCRIPTION

Figure 1:
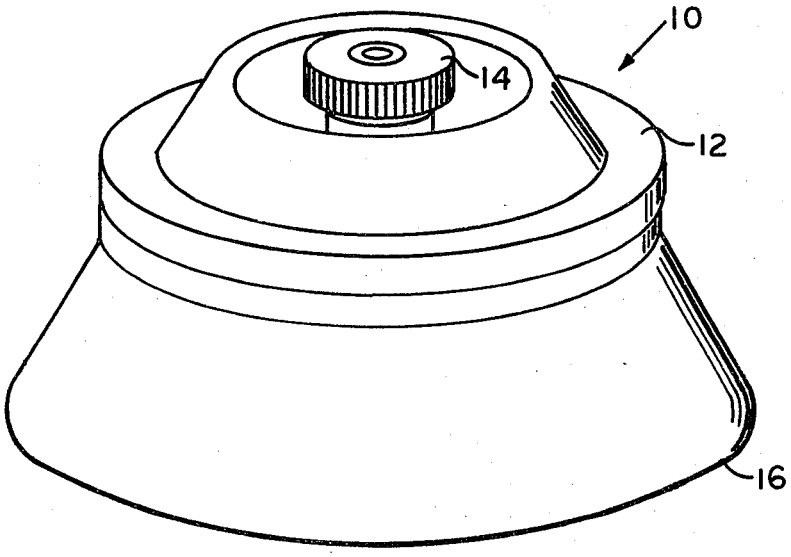
FIG. 1 is a perspective view of a centrifuge rotor and the cover of the invention.

With reference to FIG. 1, the cover of the present invention is designated generally by reference numeral 10. The cover 10, which includes a cover body 12, and a knob 14 is shown in its operating position on top of a centrifuge rotor 16.

Figure 2:
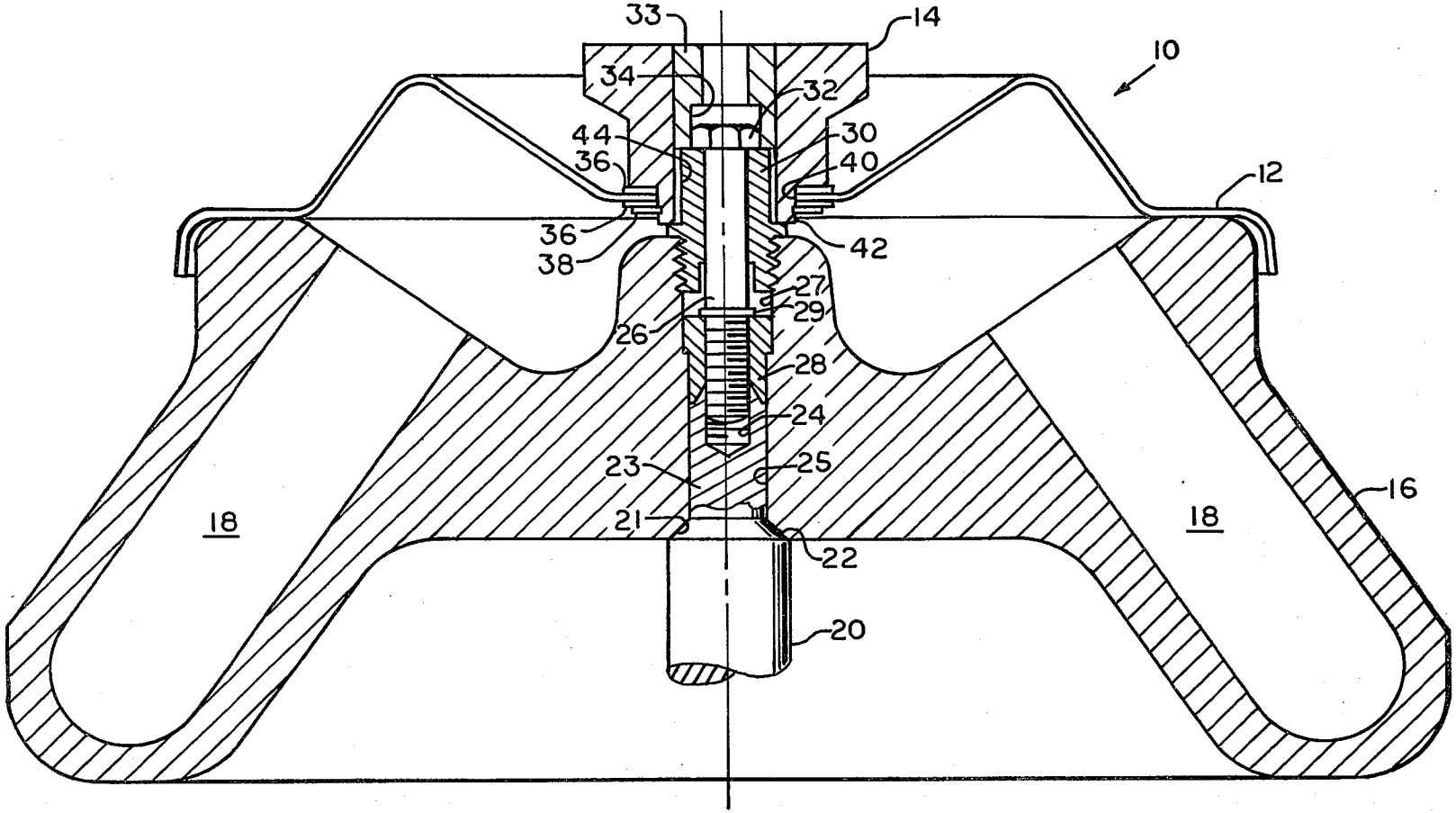
FIG. 2 is a cross-sectional side view of a centrifuge rotor and the cover of the invention as used with one type of threaded fastener for securing the rotor to a drive shaft.

Referring now to FIG. 2, the cover 10 is shown in cross section with the rotor 16 and a drive shaft 20. The rotor 16 will be seen to contain a number of recesses 18 about its periphery for containing sample tubes. In addition, the rotor 16 has an opening 25 through its center for receiving the upper end 23 of the drive shaft 20. The lower end of opening 25 contains an internal shoulder 21 which is abutted by an external shoulder 22 on the drive shaft 20. The upper end of opening 25 is provided with a recess 27 for containing a bushing 28 and a guide member 30 which is threaded into the mouth of recess 27.

The rotor 16 is secured to the drive shaft 20 by a cap screw 26. The cap screw 26, which has a hexagonal head 32 that seats against the end of guide member 30, passes through guide member 30, bushing 28 and screws into a threaded hole 24 provided in the end of the drive shaft 20. A retaining ring 29 retains the cap screw 26 captive to the guide member 30 when the rotor 16 is detached from the drive shaft 20.

The cover 10 consists primarily of a cover body 12 and a knob 14. In the preferred embodiment, the cover body 12 is formed of sheet metal and the configuration shown is well suited for enclosing the recesses 18 of the rotor 16 as well as for imparting stiffness to the cover. The knob 14 is mounted in the center of the cover body 12 and is provided with a pilot diameter 42 which extends through an opening 40 in the center of the cover body 12. A low-friction plastic washer 36 is disposed one on each side of the cover body 12 on pilot diameter 42 to assure free turning of the knob with respect to the cover body and are retained by a retaining ring 38. Preferably, the washers 36 are made of polytetrafluoroethylene or similar material.

The knob 14 is provided with a guide bore 44 which is engaged by the guide member 30 when the cover 10 is positioned on the rotor 16. The guide bore 44 and the guide member 30 have a moderately long sliding engagement length and cooperate to center the cover on the rotor. Adjacent the guide bore 44 and securely fixed to knob 14 is a socket insert 33 which has interior driving surfaces 34 that are adapted to receive and couple with the head 32 of cap screw 26.

In normal use, the cover is handled by the knob. The cover is installed on the rotor by positioning the cover over the rotor so that the guide bore 44 of the knob is aligned with the guide member 30. The cover is then lowered on the rotor so that the guide member 30 engages the guide bore 44. Before the cover reaches its fully lowered position, the head 32 of the cap screw 26 will become engaged by the socket insert 33 thereby rotatably coupling the screw to the knob.

When the cover 10 is installed on the rotor 16, the cap screw 26 securing the rotor to the drive shaft 20 may be tightened or loosened by turning knob 14. This arrangement will be seen as affording the user greater convenience than in using a separate wrench for this purpose. In addition, the arrangement provides a safety benefit in that the user can, at any time before switching on the centrifuge, verify immediately that the rotor is securely fastened to the drive shaft. To do this, it is only necessary to apply a clockwise turning force to the knob (assuming a right-hand thread). It will be seen that this can be done by the user automatically when installing the cover.

During operation of the centrifuge, the cover 10 is retained on the rotor 16 by its own weight and also by the force of differential air pressure. The latter force, as is well known to those having skill in the centrifuge art, is developed by the turbine effect of the rotor. During rotation of the rotor, the air pressure outside the rotor becomes higher than the air pressure in the interior of the rotor, and serves to keep the cover emplaced on the rotor.

Figure 3:
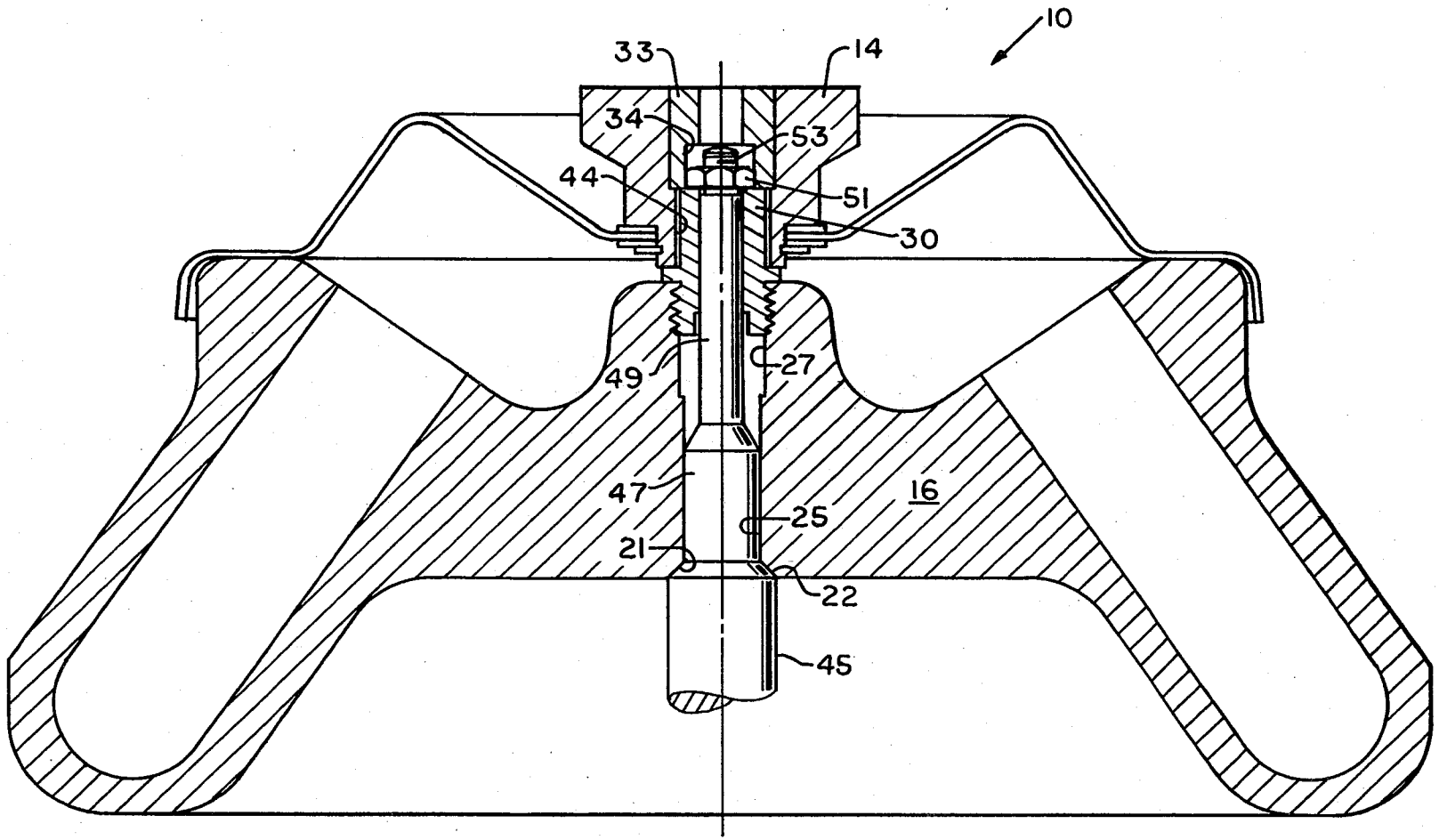
FIG. 3 is a cross-sectional view of a centrifuge rotor and the cover of the invention as used with a second type of threaded fastener for securing the rotor to a drive shaft.

Referring now to FIG. 3, the cover 10 of FIG. 2 is now shown in use with a centrifuge rotor 16 which is secured to a drive shaft 45 by a nut 51 instead of a cap screw. As shown, the rotor 16 has an opening 25 through its center for receiving the short extension 47 of the drive shaft 45. The lower end of opening 25 contains an internal shoulder 21 which is abutted by an external shoulder 22 on the drive shaft 45. The upper end of opening 25 is provided with a recess 27 which is threaded at its mouth to receive a guide member 30. The long extension 49 of the drive shaft 45 has a threaded end 53 and extends entirely through the guide member 30. The threaded end 53 is of sufficient length to enable a hexagonal nut 51 to be tightened against the guide member 30, and thereby secure the rotor 16 to the drive shaft 45.

As in the previous arrangement in which the rotor was secured to the drive shaft by a hexagonal head cap screw, the hexagonal nut 51 is engaged by the socket insert 33 when the cover 10 is positioned on the rotor 16. In this way, the nut 51 is coupled to the free-turning knob 14 of the cover 10. The nut can be either tightened or loosened without the use of a wrench by turning the knob.

Figure 4:
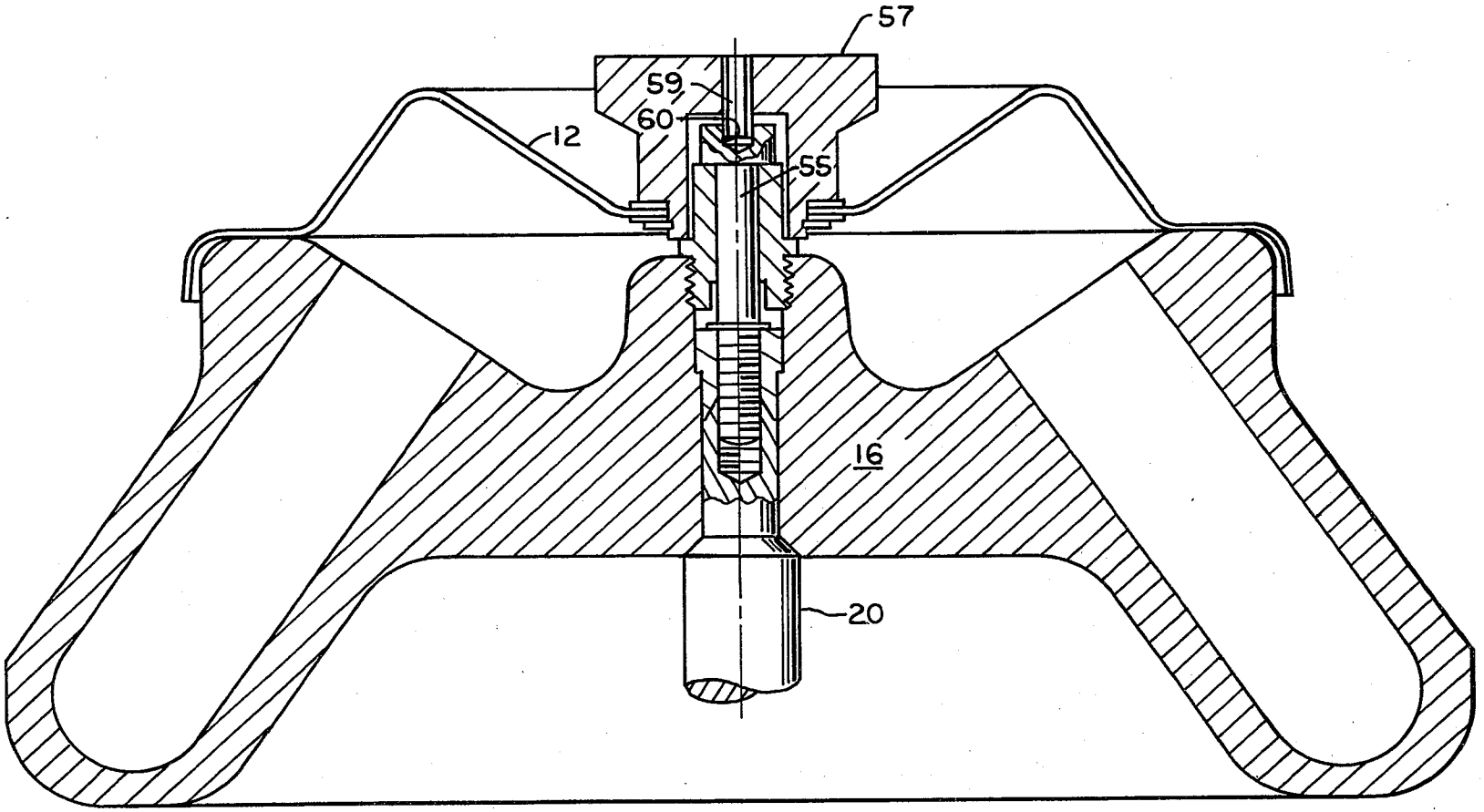
FIG. 4 is a cross-sectional view of the centrifuge rotor and the cover of the invention in an alternate embodiment thereof as used with a third type of threaded fastener for securing the rotor to a drive shaft.

Referring now to FIG. 4, the invention is shown is one of many possible alternate forms. In the arrangement shown, the cover body 12, the rotor 16 and the drive shaft 20 are identical to those of FIG. 2, except that a socket head cap screw 55 (rather than the former hexagonal head cap screw) is used to secure the rotor to the drive shaft. The knob 57, however, is adapted to engage and drive the socket head cap screw 55. The knob 57 is therefore constructed to contain a hexagonal key 59 for engaging the hexagonal socket 60 of the screw 55. Thus, when the cover is emplaced on the rotor as shown, the screw 55 can be either tightened or loosened by turning the knob 57.

It will be readily apparent that numerous other forms of threaded fasteners may be employed for securing the rotor to the drive shaft. For example, the head of the screw may be slotted and the knob of the rotor cover constructed to contain a suitable screwdriver blade. Or, the head of the screw, rather than being hexagonal, could be made square or in the form of a spline or any other form as long as suitable tool means for driving the screw are contained in the knob of the cover.

Similarly, it should be recognized that it is within the scope of the invention to machine or otherwise form tool means such as a socket, a key or the like, in the cover knob—rather than incorporating such means by attachment thereto.

While in accordance with the patent statutes there has been described what at present is considered to be the preferred embodiments of the invention, it will be understood by those skilled in the art that various changes and modifications may be made therein without departing from the invention and it is, therefore, the aim of the appended claims to cover all such changes and modifications as fall within the true spirit and scope of the invention.

What is claimed is:

1. A cover for a centrifuge rotor, said rotor having an opening through its center of rotation and being mounted on a drive shaft, said rotor secured to said drive shaft by a threaded fastener at the top of the rotor comprising:

a cover body having an opening through the center;

a knob mounted in the center of said cover body, said knob captively retained but free to turn with respect to said cover body;

tool means in said knob for rotatably coupling said knob to said threaded fastener, thereby enabling said threaded fastened to be tightened and loosened by turning said knob.

2. The cover defined in claim 1, wherein said tool means comprise a socket adapted for receiving and driving a threaded fastener.

3. The cover defined in claim 1, wherein said tool means comprise a key adapted for being received by a threaded fastener and for driving same.

4. A cover for a centrifuge rotor, said rotor having an opening through its center of rotation and mounted on a drive shaft, said drive shaft extending at least partway through said opening in said rotor, said rotor secured to said drive shaft by a threaded fastener at the top of the rotor comprising:

a cover body having an opening through the center;

a knob mounted in the center of said cover body, said knob captively retained but free to turn with respect to said cover body;

tool means in said knob for rotatably coupling said knob to said threaded fastener, thereby enabling said threaded fastener to be tightened and loosened by turning said knob.

5. The cover defined in claim 4, wherein said tool means comprise a socket adapted for receiving and driving a threaded fastener.

6. The cover defined in claim 4, wherein said tool means comprise a key adapted for being received by a threaded fastener and for driving same.

* * * * *